US005584758A

United States Patent [19]

Geib

[11] Patent Number: 5,584,758

[45] **Date of Patent: * Dec. 17, 1996**

[54] DISC-TYPE COIN SORTER WITH ADJUSTABLE TARGETING INSERTS

[75] Inventor: Joseph J. Geib, Mt. Prospect, Ill.

[73] Assignee: Cummins-Allison Corp., Mt. Prospect, Ill.

[ * ] Notice: The term of this patent shall not extend beyond the expiration date of Pat. No. 5,401,211.

[21] Appl. No.: 520,031

[22] Filed: Aug. 28, 1995

Related U.S. Application Data

[60] Division of Ser. No. 299,064, Aug. 31, 1994, Pat. No. 5,468,182, which is a continuation-in-part of Ser. No. 102, 573, Aug. 5, 1993, Pat. No. 5,401,211.

[51] Int. Cl.[6] ..... G07D 3/06

[52] U.S. Cl. ..... 453/10; 453/57

[58] Field of Search ..... 453/3, 5, 6, 9, 453/10, 12, 49, 57; 194/334, 338, 344

[56] References Cited

U.S. PATENT DOCUMENTS

| | | | |
|---|---|---|---|
| 4,086,928 | 5/1978 | Ristvedt et al. . | |
| 4,098,280 | 6/1978 | Ristvedt et al. . | |
| 4,234,003 | 11/1980 | Ristvedt et al. . | |
| 4,444,212 | 4/1984 | Ristvedt et al. . | |
| 4,506,685 | 3/1985 | Childers et al. . | |
| 4,531,531 | 7/1985 | Johnson et al. . | |
| 4,543,969 | 10/1985 | Rasmussen . | |
| 4,549,561 | 10/1985 | Johnson et al. . | |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman . | |
| 4,586,522 | 5/1986 | Taipale et al. . | |
| 4,607,649 | 8/1986 | Taipale et al. . | |
| 4,620,559 | 11/1986 | Childers et al. . | |
| 4,681,128 | 7/1987 | Ristvedt et al. . | |
| 4,731,043 | 3/1988 | Ristvedt et al. . | |
| 4,753,624 | 6/1988 | Adams et al. . | |
| 4,775,353 | 10/1988 | Childers et al. . | |
| 4,775,354 | 10/1988 | Rasmussen et al. . | |
| 4,863,414 | 9/1989 | Ristvedt et al. . | |
| 4,921,463 | 5/1990 | Primdahl et al. . | |
| 4,966,570 | 10/1990 | Ristvedt et al. . | |
| 5,009,627 | 4/1991 | Rasmussen . | |
| 5,011,455 | 4/1991 | Rasmussen . | |
| 5,022,889 | 6/1991 | Ristvedt et al. . | |
| 5,026,320 | 6/1991 | Rasmussen . | |
| 5,106,338 | 4/1992 | Rasmussen et al. . | |
| 5,123,873 | 6/1992 | Rasmussen . | |
| 5,141,443 | 8/1992 | Rasmussen et al. . | |
| 5,141,472 | 8/1992 | Todd et al. | 453/10 |
| 5,194,037 | 3/1993 | Jones et al. | 453/10 |
| 5,197,919 | 3/1993 | Geib et al. . | |
| 5,209,696 | 5/1993 | Rasmussen et al. | 453/10 |
| 5,277,651 | 1/1994 | Rasmussen et al. | 453/10 |
| 5,299,977 | 4/1994 | Mazur et al. | 453/10 |

FOREIGN PATENT DOCUMENTS

| | | | |
|---|---|---|---|
| 0138449 | 4/1985 | European Pat. Off. | 453/10 |
| 0285240 | 10/1988 | European Pat. Off. | 453/10 |
| 0360532 | 3/1990 | European Pat. Off. | 453/10 |

*Primary Examiner*—Karen Merritt
*Assistant Examiner*—Scott L. Lowe
*Attorney, Agent, or Firm*—Arnold, White & Durkee

[57] ABSTRACT

A disc-type coin sorter for sorting coin mixtures which include coin denominations of substantially similar diameters, the sorter has a rotatable disc having a resilient top surface, a drive motor for rotating the disc, a stationary sorting head having a lower surface positioned over and closely adjacent to the upper surface of the disc and having an opening in the central region thereof for feeding coins between the opposed surfaces of the disc and sorting head, the lower surface of the sorting head is contoured to align the coins in a single file and single layer, the contoured lower surface extends downwardly between exit channels at a common radial position providing a positive guide wall which maintains the radial alignment of coins as they pass between exit channels and tapers upwardly in a radial direction from the area traversed by the inner edges of the largest-diameter coins, to the top edge of the guide wall that extends between adjacent exit channels.

2 Claims, 4 Drawing Sheets

DISC-TYPE COIN SORTER WITH ADJUSTABLE TARGETING INSERTS

CROSS-REFERENCE TO RELATED APPLICATION

This application is a Divisional of U.S. patent application Ser. No. 08/299,064, filed Aug. 31, 1994, entitled "Disc-Type Coin Sorter With Adjustable Targeting Inserts" and now issued as U.S. Pat. No. 5,468,182, which is a continuation-in-part of U.S. patent application Ser. No. 08/102,573, filed Aug. 5, 1993, entitled "Disc Coin Sorter With Positive Guide Wall Between Exit Channels" and now issued as U.S. Pat. No. 5,401,211.

FIELD OF THE INVENTION

The present invention relates generally to coin sorting devices and, more particularly, to coin sorters of the type which use a resilient rotating disc and a stationary sorting head for sorting coins of mixed denominations. The coin sorter of this invention is particularly useful for sorting coin sets in which there is only a small variation in diameters among the coin denominations.

BACKGROUND INFORMATION

Although disc-type coin sorters with resilient discs have been used for a number of years, problems are still encountered in applying this technology to certain types of coin sets. Sorting heads for coin mixtures which include two coin denominations of only slightly different diameters may encounter difficulty in discriminating between coins of the different denominations. Because all coins to be sorted are usually aligned with theft outer edges at a common radial position defined by a gaging wall, and different denominations are discriminated by the distance of their inner edges from that gaging wall, coins of similar size must be precisely aligned with their outer edges against the common gaging wall in order to enter the appropriate exit channel. For example, a coin that moves just slightly beyond the common radial position may enter an exit channel intended for a smaller diameter coin. Rather than passing on to the appropriate exit channel, the larger denomination coin is issued from the exit channel intended for the smaller coin denomination. This is a coin missort.

The "target" for any given coin is the innermost end of the inboard wall of the exit channel provided for that denomination. It is the precise location of this target area of each channel, relative to the gaging wall, that determines whether or not coins of only the desired denomination enter each channel. Variations of only one or two thousandths of an inch between the gaging wall and the target area of the exit channel wall can result in missorts, essentially with coin sets in which the diameters of different coin denominations differ from each other by only six thousandths of an inch.

SUMMARY OF THE INVENTION

It is a primary object of the present invention to provide an improved disc-type coin sorter which facilitates precise positioning of the target areas of the exit channels relative to the galling walls for those channels. A related object is to provide such an improved coin sorter which improves the accuracy of sorting a wide variety of different coin sets.

It is another object of this invention to provide such an improved disc-type coin sorter which enables the location of the target areas of the exit channels to be precisely adjusted after the machining of the sorting head, and even after the sorter has been in use.

Still another object of this invention is to provide a coin sorter which improves the reliability of sorting coin sets having two or more coin denominations with only slightly different diameters.

A further object of the invention is to provide such an improved coin sorter which can be efficiently and economically manufactured.

Other objects and advantages of the invention will be apparent from the following detailed description and accompanying drawings.

In accordance with the present invention, the foregoing objectives are realized by providing a disc-type coin sorter for sorting coin mixtures which include coin denominations of substantially similar diameters. The sorter has a rotatable disc having a resilient top surface, a drive motor for rotating the disc, and a stationary sorting head having a lower surface positioned parallel to the upper surface of the disc and spaced slightly therefrom. The lower surface of the sorting head is contoured to align the coins in a single file and single layer of coins, and to form a plurality of exit channels for receiving the queued coins and guiding coins of different diameters to different exit stations along the periphery of the sorting head. An adjustable insert forms the radially innermost end of the inboard wall of at least one of the exit channels. The insert is releasably mounted in the lower surface of the sorting head for movement, when the insert is released, in a direction transverse to the direction of coin movement adjacent the insert.

In a preferred embodiment of the invention, the portion of the lower surface of the sorting head that is traversed by coins between the first and last exit channels tapers upwardly in a radial direction from the area traversed by the inner edges of the largest-diameter coins, to the top of the guide wall that extends between adjacent exit channels.

DESCRIPTION OF THE PREFERRED EMBODIMENTS

Figure 1:
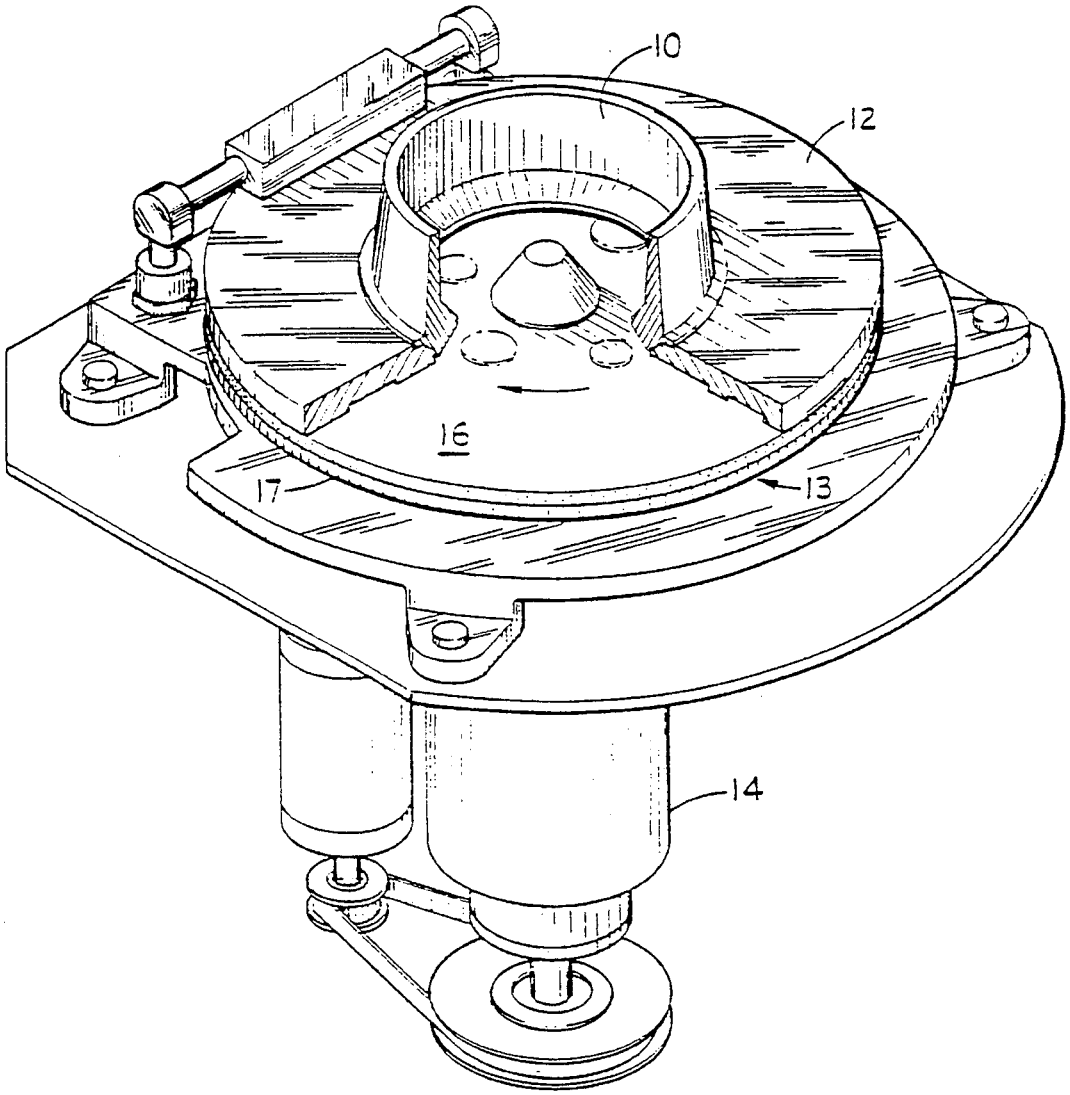
FIG. 1 is perspective view of a coin sorter embodying the present invention, with portions thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a feed opening 11 (FIG. 2) in an annular sorting head or guide plate 12. As the coins pass through the feed opening 11, they are deposited on the top surface of a rotatable disc 13. This disc 13 is mounted for rotation on a stub shaft (not shown) and driven by an electric motor 14 mounted to a base plate (not shown). The disc 13 comprises a resilient pad 16 bonded to the top surface of a solid metal disc 17.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the sorting head 12 because the underside of the inner periphery of this plate is spaced above the pad 16 by a distance which is approximately the same as the thickness of the thickest coin. As further described below, the coins are sorted into their respective denominations, and the coins for each denomination issue from a separate exit channel, such as the channels 20, 21, 22, 23, 24 and 25.

In general, the coins for any given currency are sorted by the variation in diameter of the various denominations. Prior to sorting, the coins are manipulated between the sorting head and the rotating disc to queue the coins into a single-file, single-layer stream of coins. The outer edges of all the coins in this stream of coins are normally aligned at a common radius so that the inner edges of the coins can be engaged to discriminate among coins of different diameters, directing the coins to the desired exits for the respective denominations.

Figure 2:
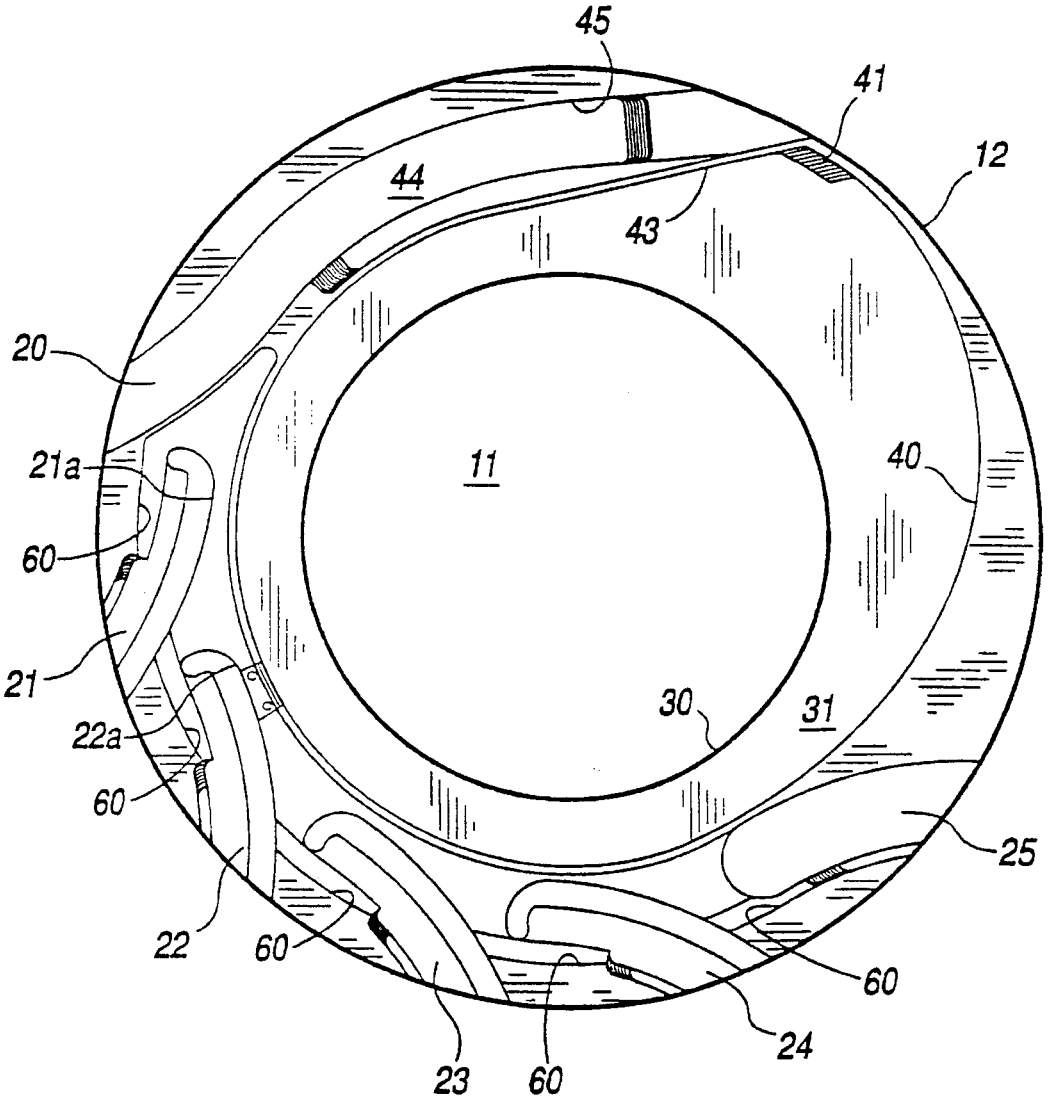
FIG. 2 is a bottom plan view of the sorting head or guide plate in the coin sorter of FIG. 1.

Turning now to FIG. 2, there is shown a bottom view of the preferred sorting head 12 including various channels and other means especially designed for high-speed sorting with positive control of the coins. It should be kept in mind that the circulation of the coins, which is clockwise in FIG. 1, appears counterclockwise in FIG. 2 because FIG. 2 is a bottom view. The various means operating upon the coins include an entry region extending around the entire inner periphery 30 of the sorting head, a queuing region which includes a spiral wall 40, and the exit channels 20–25 for six different coin denominations.

Considering first the entry region, the coins deposited on the rotating disc 13 directly beneath the feed opening 11 are carried under the inner periphery 30 of the sorting head into an annular recess 31 extending around the entire circumference of the sorting head. Coins can move radially into the recess 31, which is spaced above the top surface of the pad 16 by a distance which is about the same as the thickness of the thickest denomination of coin.

Radial outward movement of coins within the recess 31 is terminated when they engage the outer wall 40, though the coins continue to be moved circumferentially along the wall 40 by the rotational movement of the disc 13. The outer wall 40 of the recess 31 extends down to the lowermost surface of the sorting head 12, which is preferably spaced from the top surface of the pad 16 by a distance, e.g., 0.005 inch, which is less than the thickness of the thinnest coin. Consequently, free radial movement of the coins is terminated when they engage the outer wall 40, though the coins continue to move circumferentially along the wall 40 by the rotational movement of the pad.

At the end of the spiral wall 40, i.e., at the point where the spiral wall reaches its maximum diameter, the coins engage a ramp 41 which presses the coins downwardly into the resilient surface of the rotating disc. The outer edges of coins which engage the outer wall 40 have a common radial position and are ready for sorting. Coins whose radially outer edges do not engage the outer wall 40 engage a transverse wall 43 which guides such coins back into the entry recess 31 for recirculation.

It can occur that correctly aligned coins passing under the recycling wall 43 can be slightly shifted in their radial position. To correct this, coins which pass the recycling wall 43 enter a gaging channel 44 which allows the coins to be realigned against an outer wall 45. The channel 44 and wall 45 allow the coins in the sorting path an opportunity to realign their outer edges at the radial position required for correct sorting. To ensure that every coin engages the wall 45, the radius of the wall 45 from the center of the disc is gradually decreased along the length of the channel 44.

Downstream of the gaging channel 44, the sorting head 12 forms the series of exit channels 20–25 spaced circumferentially around the outer periphery of the sorting head. The inner end of the inboard, or downstream, wall of each successive exit channel is located progressively farther away from the common radial location of the outer edges of all the coins, so that the exit channels receive and eject coins in order of increasing diameter. Because the outer edges of all coins are located at the same radial position, coins of the smallest diameter will be the only ones allowed to enter the first exit channel. Each exit channel extends outwardly to the periphery of the sorting head so that the inboard wall of each exit channel guides the coins in that channel outwardly and eventually ejects those coins from between the sorting head 12 and the resilient pad 16.

In the illustrative coin sorter, which is intended for the Japanese coin set, the exit channel 21 is intended to discharge only Japanese 50-yen coins, and thus the inboard edge 21*a* of this channel is located at a radius that is spaced inwardly from the final radius of the gaging wall 45 by a distance that is only slightly greater than the diameter of a 50-yen coin. Consequently, only 50-yen coins can enter the channel 21. Because the outer edges of all denominations of coins are located at the same radial position when they leave the gaging channel 44, the inner edges of all denominations other than the 50-yen coin extend inwardly beyond the inboard edge of the exit channel 21, thereby preventing those coins from entering the channel 21.

At exit channel 22, the inner edges of only the Japanese 5-yen coins are located close enough to the periphery of the sorting head 12 to enter the exit channel. The inner edges of all the larger coins extend inwardly beyond the inboard edge 22*a* of the channel 22 so that they remain gripped between the sorting head 12 and the resilient pad 16. Consequently, all the coins except the 5-yen coins continue to be rotated past the exit channel 22.

Similarly, only Japanese 100-yen coins enter the channel 23, only 10-yen coins enter the channel 24, and only 500-yen coins enter the channel 25.

For the exit channels 20–25 to properly discriminate between such similarly sized coin denominations, all coins must have their outer edges precisely aligned at a common radius to place their inner edges at the precise radii of the inner ends of the inboard walls of the exit slots for the various coin denominations. When the coins traversing the exit channels are held in place solely by pressure between the sorting head and the pad, the positions of the coins may shift slightly outward as they cross the exit channels. Any outward movement of a coin equalling the difference between the diameter of that coin and the diameter of the next smaller coin will result in premature exiting of the shifted coin.

With American and Canadian coin sets, slight outward shifting of aligned coins held only by pad pressure is tolerable because pad pressure alone is sufficient to keep the radial movement of coins well within the required tolerance range. Coin sets of other countries, however, are more sensitive. The Japanese coin set, for example, consists of coins which can vary in diameter by as little as 0.015 of inch. Pad pressure alone is insufficient to reliably maintain the radial alignment of coins within the tight tolerances required by coin sets, such as the Japanese set, where the coin diameters are so similar.

Figure 4:
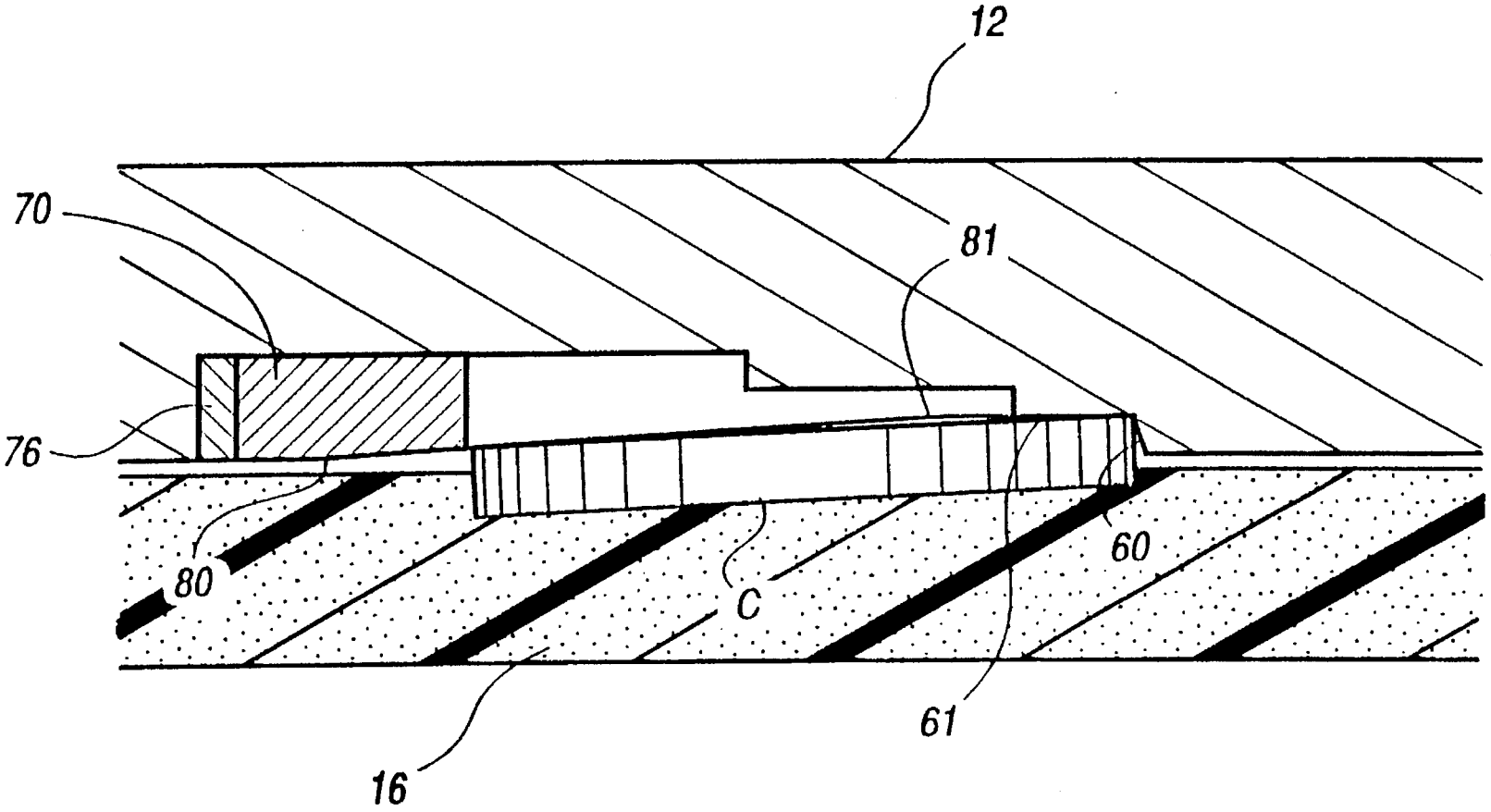
FIG. 4 is an enlarged section taken generally along line 4–4 in FIG. 3.

The sorting head 12 alleviates the problem of outward movement of coins as they traverse the exit channels by providing a gaging wall 60 for positive control of coins as they pass between exit channels. A coin of large diameter will pass the first exit channel 20 and be engaged by the positive gaging wall 60 to maintain the coin at the desired radial position as it passes to the next exit channel. By positively maintaining the outer edge of the coin at the desired radial position, the possibility of a coin moving radially outward as it passes between exit channels is virtually eliminated. As can be seen in FIG. 4, the gaging wall is tapered outwardly from the top edge of the wall to the bottom edge.

The gaging wall 60 is interrupted by the successive exit channels 21–25 but is continuous between each pair of adjacent exit channels. The shoulder 61 on the inboard side of the gaging wall 60 intrudes slightly into each of the exit channels 21–25, but this shoulder 61 merely causes the exiting coins to tilt as they enter and travel along the exit slots. This tilting raises the inner edges of the coins into the exit channel, which is desirable for retaining the exiting coins within their respective exit channels.

To ensure firm engagement of coins with the gaging wall 60, the portion of the lower surface of the sorting head traversed by coins as they are carried along the gaging wall 60 is tapered, as can be seen in FIG. 4. The taper is in the radial direction, and extends upwardly from the region 80 adjacent the inner edges of the coins to the shoulder 61 on the inboard side of the gaging wall 60. The effect of the taper is to bias the coins outwardly against the gaging wall 60.

Figure 3:
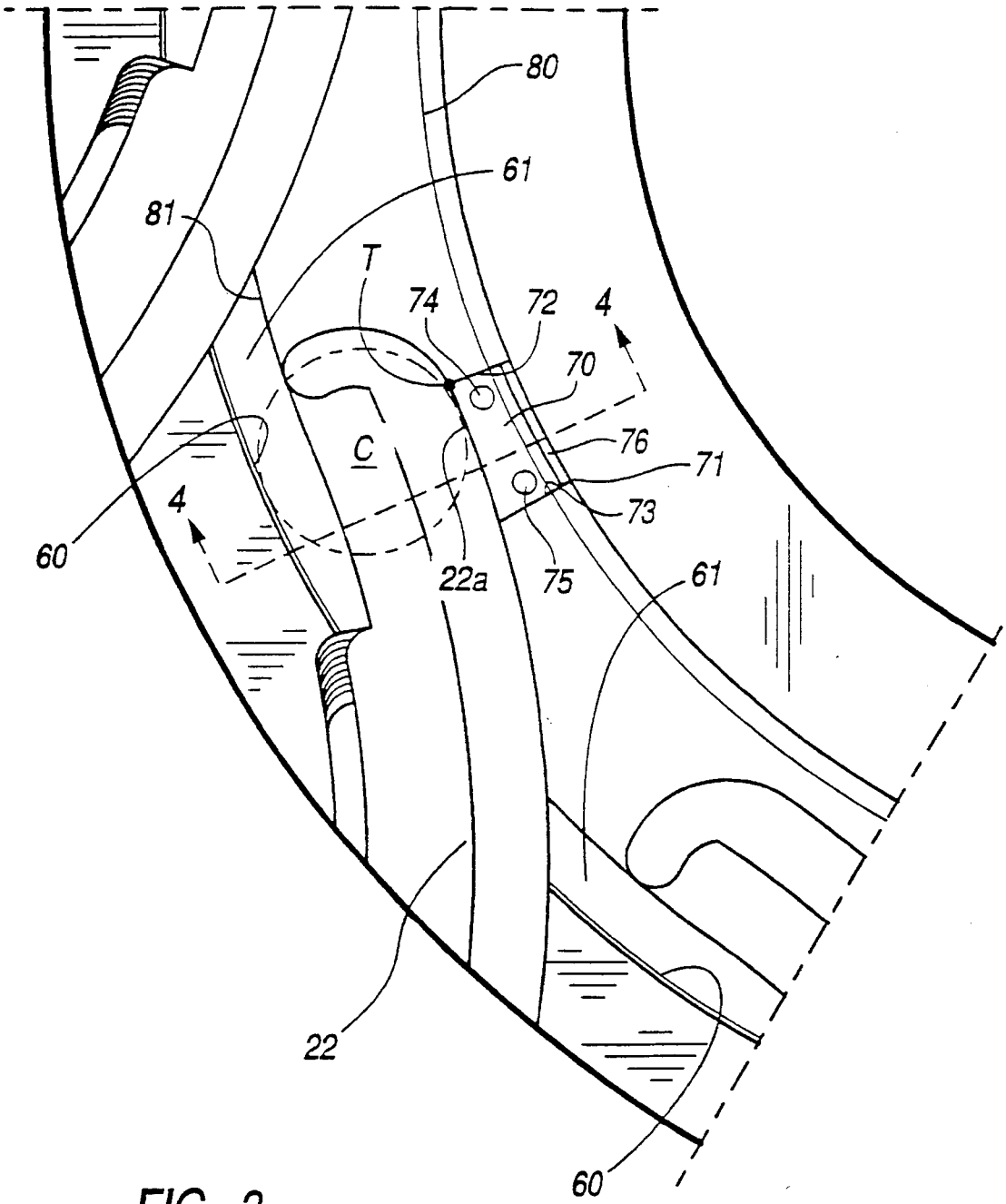
FIG. 3 is a enlargement of the lower left hand portion of FIG. 2.

FIGS. 3 and 4 illustrate a coin C that has just reached the inner end of an exit channel 22. All coins having a diameter smaller than the diameter of the coin C should have been discharged through a preceding exit channel. Coins having diameters larger than the diameter of the coin C should bypass the channel 22 for discharge through a subsequent exit channel downstream of the channel 22. The outer edge of the coin C is gaged by the wall 60, as a result of which the radially innermost edge of the coin C follows a path parallel to that of the outer gaging wall 60, until the inner edge of the coin C enters the exit slot 22. It can be seen from this illustration that the critical portion of the inboard wall **22*a* of the exit channel 22 begins at the innermost point T, referred to herein as the "target" point of the inboard wall of the exit channel. If this target point T is too close to the gaging wall 60, the coin C will be prevented from entering the exit channel 22. If the target point T is located too far away from the gaging wall 60, undesired coins having a diameter just slightly larger than that of the coin C will be allowed to enter the exit channel 22, resulting in a missort and perhaps causing jamming of the sorting machine. Thus, it can be seen that the precise location of the target point T relative to the gaging wall 60 is especially important to the successful operation of the sorter, particularly when the machine is being used to sort coin sets having coin diameters very close to each other. For example, the French coin set has two coins which differ from each other by only six thousandths of an inch. Of course, manufacturing tolerances in the production of the coins themselves can reduce this small differential in the diameters of the coins even further. Although a sorting head of the type illustrated in FIGS. 3 and 4 is normally machined with extremely small manufacturing tolerances, nevertheless there is inevitably a small mount of variation in the precise locations of the gaging wall 60** and the target point T relative to each other.

To permit the target portion of the inboard wall of the exit channel 22 to be finely adjusted to precisely the desired position relative to the gaging wall 60, the target portion of the channel wall **22*a* is formed by an adjustable insert 70. This insert 70 is received in a short channel 71 whose side walls 72 and 73 define a path that is substantially normal to the section of the gaging wall 60 that is directly opposite the target point T. The insert 70 is held securely within the channel 71 by a pair of screws 74 and 75 which may be retracted when it is desired to adjust the position of the insert 70 by sliding it along the walls of the channel 71. The screws 74 and 75 pass through oversized or slightly elongated holes in the insert 70** and are threaded into the sorting head above the insert.

The full range of movement allowed by the dimensions of the insert holes and the fastening screws 74 and 75 is only a few thousandths of an inch, which is more than adequate for the fine adjustments for which the insert is utilized. These adjustments may be quickly and easily made, either at the time of manufacture and testing of the sorting head, or at the location where the sorter is installed for actual use. The insert 70 may even be adjusted to correct malfunctions of the sorter after it has been in use for a considerable period of time, or even to compensate for wear on the wall section formed by the insert. If the inserts themselves wear excessively, they can be replaced to prolong the grating life of the sorting head.

As can be seen in FIG. 4, a shim 76 is inserted between the inner surface of the insert 70 and the opposed wall of the channel 71. The thickness of this shim 76 may be used to control the precise position of the insert 70. In addition, the shim 76 serves to prevent retracting movement of the insert 70 during operation of the coin sorter.

I claim:

1. A disc-type coin sorter for sorting coin mixtures which include coins of mixed diameters, said sorter comprising:

a rotatable disc having a resilient top surface, a stationary sorting head having a lower surface positioned parallel to the resilient top surface of said disc and spaced slightly therefrom, the lower surface of said sorting head forming a queuing region for aligning the outer edges of coins of all denominations at a common radius along a first guide wall, a plurality of exit channels for receiving the queued coins and guiding coins of different diameters to different exit stations along the periphery of the sorting head, a second guide wall extending between at least selected pairs of adjacent exit channels for engaging and guiding the outer edges of coins that do not enter at least the first of the pair of adjacent exit channels, said second guide wall maintaining the outer edges of the engaged coins at said common radius, and a portion of the lower surface of the sorting head that is traversed by coins between a first and last exit channels tapering upwardly in a radial direction from an area traversed by inner edges of the largest-diameter coins, to a top edge of said guide wall that extends between adjacent exit channels.

2. A disc-type coin sorter for sorting coin mixtures which include coins of mixed diameters, said sorter comprising:

a rotatable disc having a resilient top surface, a stationary sorting head having a lower surface positioned parallel to the resilient top surface of said disc and spaced slightly therefrom, the lower surface of said sorting head forming a queuing region for aligning the outer edges of coins of all denominations at a common radius, a plurality of exit channels for receiving the queued coins and guiding coins of different diameters to different exit stations along the periphery of the sorting head, a guide wall, separate from said queuing region, extending between at least selected pairs of adjacent exit channels for engaging and guiding the outer edges of coins that do not enter at least the first of the pair of adjacent exit channels, said guide wall maintaining the outer edges of the engaged coins at said common radius, and a portion of the lower surface of the sorting head that is traversed by coins between a first and last exit channels tapering upwardly in a radial direction from an area traversed by inner edges of the largest-diameter coins, to a top edge of said guide wall that extends between adjacent exit channels.

* * * * *